United States Patent [19]

Sekiguchi

[11] 4,063,438

[45] Dec. 20, 1977

[54] METHOD OF CONTROLLING TANDEM ROLLING MILLS

[75] Inventor: Kunio Sekiguchi, Kawagoe, Japan

[73] Assignee: Tokyo Shibaura Denki Kabushiki Kaisha, Kawasaki, Japan

[21] Appl. No.: 748,369

[22] Filed: Dec. 7, 1976

[30] Foreign Application Priority Data

Dec. 10, 1975 Japan ..... 50-147162

[51] Int. Cl.[2] ..... B21B 37/00

[52] U.S. Cl. ..... 72/6; 72/21; 72/205

[58] Field of Search ..... 72/6–12, 72/19–21, 205

[56] References Cited

U.S. PATENT DOCUMENTS

| | | | |
|---|---|---|---|
| 3,722,244 | 3/1973 | Fujii | 72/16 |
| 3,727,441 | 4/1973 | Morooka | 72/6 |

*Primary Examiner*—Milton S. Mehr

*Attorney, Agent, or Firm*—Stevens, Davis, Miller & Mosher

[57] ABSTRACT

A method of controlling a tandem rolling mill so as to minimize strip tension variations when the pass schedule is being changed. This result is achieved by selectively changing the roll speeds of the stands and the roll openings by means of an electronic computer.

1 Claim, 2 Drawing Figures

METHOD OF CONTROLLING TANDEM ROLLING MILLS

BACKGROUND OF THE INVENTION

This invention relates to a method of controlling a tandem rolling mill including a plurality of mill stands which are arranged in tandem for rolling a metal strip. The method minimizes the variation in the tension of the strip when the pass schedule is changed during operation of the mill thus decreasing production difficulties and the quantity of off gauge strip produced at the time the pass schedule is changed.

For the purpose of improving productivity, a rolling mill is generally used to produce strips having different gauges from the same coil of strip or to continuously produce a strip by sequentially interconnecting strips of different coils having the same or different size. To this end, it is necessary to change the pass schedule without stopping the mill and a number of methods of controlling the mill have been developed.

According to one prior art method, when a size changing point reaches a certain stand the set amount of the roll opening of that stand is changed to a value corresponding to the pass schedule for the changed size while at the same time the speed of all of the stands on the inlet side or the exit side of that stand is changed while maintaining the speed ratio at a constant value.

For example, in a tandem mill including $(i-1)$th, $i$th and $(i+1)$th stands as shown in FIG. 1, the size changing point X is shown at a point X immediately on the outlet side of stand $i$. In this case, let us denote the schedule before size changing by A schedule and that after size changing by B schedule. Then according to this method, since the size changing point X has already reached the $i$th stand, the roll opening of the $(i-1)$th stand has already been changed to the set value of the B schedule. On the other hand, the roll opening of the $(i+1)$th stand is the set value of the A schedule. At this time, the set value of the roll opening of the $i$th stand should be rapidly changed from the A schedule to the B schedule, the speed ratio between the $(i-1)$th and $i$th stands should be changed to that for the B schedule and the speed ratio between the $i$th stand and the $(i+1)$th stand should be maintained at the ratio for the A schedule. However, since the strip gauge on the exit side of the $i$th stand is not equal to that of the A schedule a tension variation caused by the difference in the volume speeds of the A and B schedules reflects on the tension of the strip between the $i$th and $(i+1)$th stands. For this reason, the inlet strip gauge and the back tension of the $i$th stand are the values of the B schedule and different from the target value of the front side tension so that the exit strip gauge is different from the target gauge of the B schedule. In the same manner, with regard to the $(i+1)$th stand, since the back tension is different from that of the A schedule the exit strip gauge of the $(i+1)$th stand becomes different from the target value of the A schedule. Thus, the front side tension of a stand which the size changing point has reached must necessarily be changed, and depending upon the extent of the size change the tension variation becomes excessive, thus producing a large quantity of off gauge product.

SUMMARY OF THE INVENTION

It is an object of this invention to provide an improved method of controlling a tandem rolling mill capable of minimizing the strip tension variation at the time of changing the pass schedule while the mill is operating thereby reducing production difficulties and the fabrication of off gauge products.

According to this invention, there is provided a method of controlling a tandem rolling mill including $n$ stands, where $n$ is an integer, and utilized to roll a metal strip. The method comprises the steps of, at the time of changing the pass schedule during operation of the mill and before the size changing point of the strip reaches the first stand changing the roll speed of the last stand to that of after size changing; changing the roll speed of the other mill stands while maintaining the speed ratio of before size changing; when the size changing point reaches any intermediate stand between the first and $(n-1)$th stands, changing the roll speed of the $i$th stand so as to maintain the exit strip speed thereof at the speed of before size changing; at the same time changing the roll opening of the $i$th stand so as to maintain the interstand strip tension between the $i$th and $(i+1)$th stands at the value of before size changing but to change the exit strip gauge of the $i$th stand to a predetermined target value of after size changing; changing the roll opening of the $i$th stand to a predetermined set value of after size changing; changing the roll speeds of the roll stands on the upstream side of the $i$th stand while maintaining the volume speed of after size changing; and when the size changing point reaches the last stand; changing the roll openings of the last and the $(n-1)$th stands to predetermined set values of after size changing while at the same time changing the roll speeds of the first to the $(n-1)$th stands to predetermined preset values of after size changing.

BRIEF DESCRIPTION OF THE DRAWINGS

The invention can be more fully understood from the following detailed description taken in conjunction with the accompanying drawings in which.

DESCRIPTION OF THE PREFERRED EMBODIMENT

For the sake of description, various parameters are defined as follows.

$H_i$: inlet gauge of the $i$th stand
$h_i$: outlet gauge of the $i$th stand
$t_{bi}$: back tension stress of the $i$th stand
$t_{fi}$:: front tension stress of the $i$th stand
$S_{oi}$: roll opening of the $i$th stand
$V_{ni}$: roll speed of the $i$th stand
$V_{ei}$: inlet strip speed of the $i$th stand
$V_{oi}$: exit strip speed of the $i$th stand
$f_i$: forward slip of the $i$th stand
$M_i$: mill constant of the $i$th stand
$T_{i,i+1}$: total interstand tension between the $i$th and $(i+1)$th stands.

Also, in the following description, W represents the width of the strip and the discrimination between schedules A and B are made by suffixes A and B.

Usually, the speed reference circuit for a tandem rolling mill comprises a stand speed setter (SSRH) which sets the speed ratio of respective stands and a speed setter which sets the overall rolling speed of the rolling mill. The set value of SSRH is determined in accordance with a specific pass schedule. Accordingly, the value of the SSRH of the last stand is different for schedules A and B. For this reason, when the value of SSRH for the last stand is changed to the set value of the B schedule before the size changing point reaches the first stand and at the same time when the speeds of the other stands are varied so as to maintain the speed ratio of the A schedule, the roll speed setting of the last stand would be the same as that obtained when the changing of the schedule to B has been completed. In this specification the roll speeds $V_{ni,A}$ and $V_{ni,B}$ of respective stands for schedules A and B, and the roll openings $S_{oi,A}$ and $S_{oi,B}$ represent the values when the value of SSRH for the last stand is changed.

Figure 1:
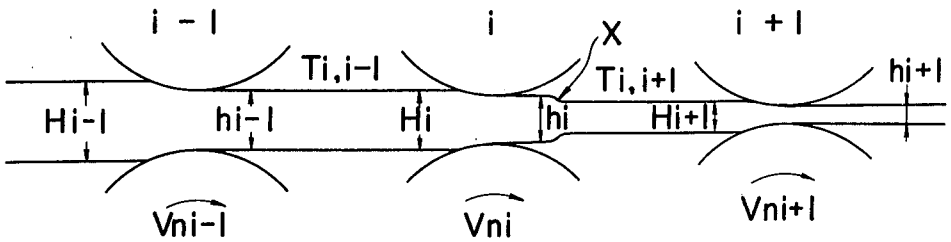
FIG. 1 is a diagrammatic representation of a tandem rolling mill useful to explain the principle of this invention.

When the size changing point X reaches the $i$th stand as shown in FIG. 1, the roll openings and the speed ratio of the stands on the downstream side of the $(i+1)$th stand are set to the values for schedule A so that it is not necessary to change them. The inlet strip gauge of the $(i+1)$th stand is the strip gauge $H_{i+1,A}$ for the A schedule until the size changing point reaches the $(i+1)$th stand. Accordingly, in order to maintain the exit strip gauge of the $(i+1)$th stand at $h_{i+1,A}$ it is necessary to maintaim the back tension stress at $t_{bi+1,A}$. Thus, the roll speed $V_{ni}$ of the $i$th stand is determined and changed such that the interstand tension between the $i$th and $(i+1)$th stands will be equal to the value $T_{i,i+1,A}$ for the A schedule. Assume now that the exit strip gauge is equal to the target strip gauge $h_{i,B}$ for the B schedule, the front tension stress of the $i$th stand is expressed by the equation $$t_{fi'} = \frac{T_{i,i+1,A}}{h_{i,B} \cdot W_B} \tag{1}$$

which is generally different from the front tension stress $t_{fi,B}$ of the B schedule. In this manner, the roll opening of the $i$th stand which is necessary to make the exit strip thickness of the $i$th stand equal to $h_{i,B}$ is not the set value $S_{oi,B}$ for the B schedule but equal to $S_{oi'}$, and the roll speed is not $V_{ni}$ but is equal to $V_{ni'}$.

A first feature of this invention lies in that the values of $V_{ni'}$ and $S_{oi'}$ are predetermined by calculation and that these value are rapidly changed when the size changing point arrives at the $i$th stand.

It is well known in the art that the variation in the interstand tension between the $i$th and $(i+1)$th stands is expressed by the following equation $$\frac{dT_{i,i+1}}{dt} = h_i \cdot W \cdot K\,(V_{ei+1} - V_{oi}) \tag{2}$$

where $K$ represents a constant.

As this equation shows, even when the thickness and the width of the strip vary, unless the inlet speed of the $(i+1)$th stand and the exit speed of the $i$th stand are not different, the interstand tension between the $i$th and $(i+1)$th stands does not vary. Accordingly, even after the size changing point X has reached the $i$th stand, it is possible to maintain the total tension at the value $T_{i,i+1,A}$ by controlling the exit strip speed to be $V_{oi,A}$. The roll speed of the $i$th stand necessary to attain this object is expressed by the following equation (3)

$$V_{ni'} = \frac{V_{oi,A}}{1 + f_{i'}} \tag{3}$$

where $f_{i'}$ represents the forward slip of the $i$th stand when the inlet strip gauge is equal to $H_{i,B}$, exit strip gauge is $h_{i,B}$, the back tension stress is $t_{bi,B}$ and the front tension stress is equal to $t_{fi'}$ which is determined by equation (1). This value of $f_{i'}$ can be readily determined by well known theoretical equations regarding strip rolling.

On the other hand the roll opening $S_{oi'}$ can be determined by the following equation (4)

$$S_{oi'} = h_{i,B} - \frac{P_{i'}}{M_i} \tag{4}$$

In equation (4) the mill constant $M_i$ can be measured from an actual installation and the rolling load $P_{i'}$ can be calculated from the inlet and exit strip gauges, the back tension stress and the strip width for the B schedule when the front tension stress is equal to $t_{fi'}$, in the same manner as the forward slip $f_{i'}$. Such calculation can readily be made by using well known theoretical equations regarding a rolling mill or by using experimental equations.

Turning now to the $(i-1)$th stand, after the size changing point X has reached this stand, the roll speed and the roll opening of this stand are changed to $V_{ni-1}$ and $S_{oi'-1}$ respectively. When the size changing point X reaches the $i$th stand all stands on the upstream side of the $i$th stand operate under the B schedule. Thus, after the size changing point X has reached the $i$th stand the roll opening of the $(i-1)$th stand is changed to $S_{oi-1,B}$ from $S_{oi'-1}$ and the roll speeds of the stands (including the $(i-1)$th stand on the upstream side) are quickly changed to the values calculated by the following equation (5) based on the principle of constant volume speed. This is the second feature of this invention $$V_{nj} = \frac{\frac{h_{i,B}}{h_{j,B}} \cdot V_{oi,A}}{1 + f_j} \tag{5}$$

where $j = 1 - (i-1)$

The foregoing description relates to the method of changing the set values of the roll opening and the roll speed for stands up to $i = (n-1)$th stand where $n$ represents the total number of the stands.

As above described, at the last stand it is not necessary to vary its roll speed whereas the roll opening is changed to the roll opening $S_{on,B}$ for the B schedule after the size changing point X has reached the last stand. At the same time, the roll opening of the $(n-1)$th stand is changed to $S_{on-1,B}$ and the roll speeds of from the first to the $(n-1)$th stands are changed to $V_{ni,B}$ ($i = 1$ through $(n-1)$)

By the method described above it is possible to eliminate variation in the front tension of a stand which the size changing point has reached thereby enabling smooth changing of the pass schedule without increasing the amount of off gauge product.

Figure 2:
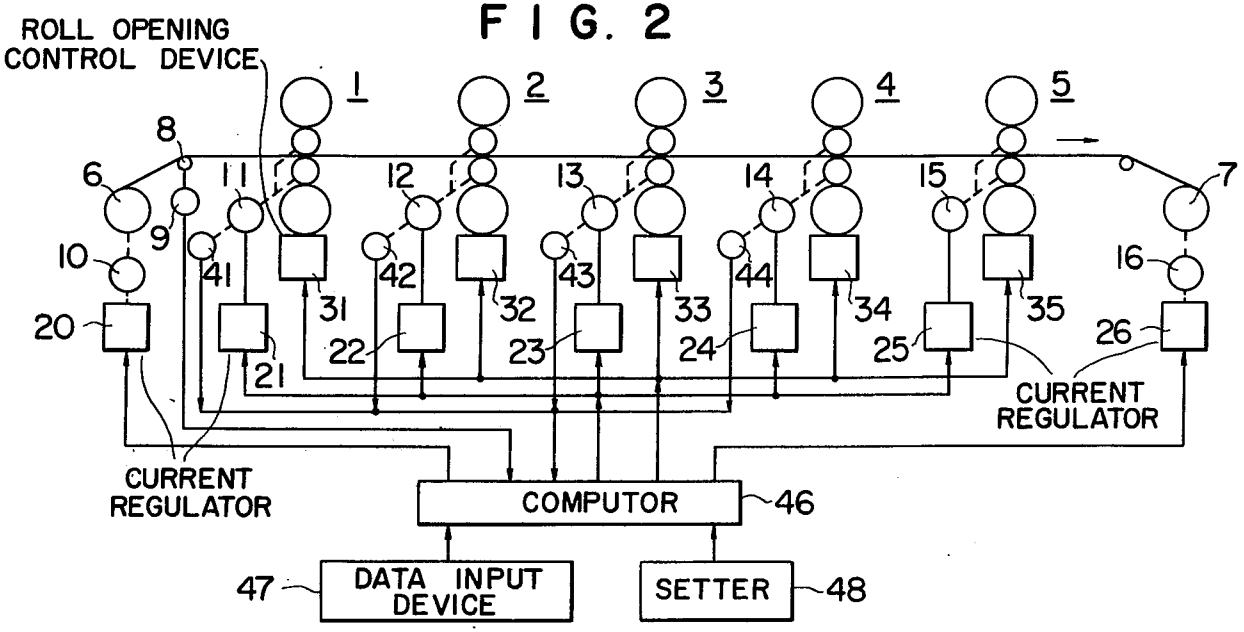
FIG. 2 is a block diagram of a control system utilized to work out the method of this invention.

One embodiment of this invention will be described hereunder with reference to FIG. 2 in which a 5 stand tandem cold rolling mill is used to manufacture finished strips having different gauges from the same strip coil. The rolling mill comprises five mill stands 1 through 5 each including a pair of work rolls and a pair of back up rolls. A metal strip payed out from a pay off reel 6 is rolled and then taken up by a tension reel 7. The pay off reel 6 is driven by a DC motor 10 whose armature current is controlled by a current regulator 20 for the purpose of maintaining the back tension of the first stand 1 at a target value. Respective stands 1 through 5 are driven by DC motors 11 through 15 respectively, the speeds of these motors being controlled by speed regulators 21 through 25 respectively to operate them at their target speeds. The tension reel 7 is driven by a DC motor 16 whose armature current is controlled by a current regulator 26 for maintaining the front tension of the stand 5 at a target value. Various data, such as the strip gauge, tension, etc. for the A and B schedules are set in an electronic computer 46 by a data input device 47 such as a card reader. The computer 46 is constructed to calculate the speed ratio and the set value of the roll opening of each stand according to a predetermined program. Also the computer calculates the roll speed and the set value of the roll opening at the time of changing the pass schedule from A to B according to the method and procedure described hereinabove.

The setting of the size changing point is made by setting the length of the strip from the reel 6 in a setter 48 which is used to set the length in the computer 46. The length of the rolled strip is calculated by the computer 46 from a signal produced by a tachometer generator 9 driven by a length detector, for example a touch roller 8 located on the inlet side of the stand 1. When the calculated value and the value set by the setter coincide with each other, this point is taken as the size changing point. The time at which the size changing point reaches stand 1 can be determined by using this signal. The time at which the size changing point reaches stand 2 can be determined by integrating the output signal generated by a tachometer generator 41 utilized to detect the number of revolutions of the driving motor of stand 2 so as to determine the distance of travel of the size changing point and by utilizing this distance and the spacing between adjacent stands. In the same manner, tachometer generators 42, 43 and 44 are provided for stands 3, 4 and 5 to utilize their outputs. Under A schedule mill operation, when the computer 46 judges that the size changing point is approaching stand 1, the computer changes the speed setting of stand 5 to that of the B schedule while at the same time changes the speeds of stands 1 to 4 while maintaining the speed ratio determined by A schedule. When the size changing point reaches stand 1 computer 46 supplies to the current regulator 20 for the pay off reel driving motor 6 a current reference necessary to change the back tension of stand 1 to that of the B schedule. At the same time, the computer supplies reference signals to the roll opening control device 31 and to the speed control device 21 for changing the roll opening of stand 1 to $S_{o1'}$ determined by equation (4) and for changing the roll speed to $V_{n1'}$ determined by equation (3).

When the size changing point reaches stand 2 the roll opening and the roll speed of stand 2 are changed to $S_{o2'}$ and $S_{n2'}$ respectively, while at the same time the roll opening of stand 1 is changed to $S_{o1,B}$ of the B schedule and the roll speed of stand 1 is changed to a value determined by equation (5). As the size changing point reaches stand 3, the roll opening and the roll speed of this stand are changed to $S_{o3'}$ and $V_{n3'}$ respectively, the roll opening of stand 2 to $S_{o2,B}$ and the roll speeds of stands 2 and 1 are changed to values determined by equation (5). In the same manner, when the size changing point reaches stand 4 the roll opening and the roll speed of this stand are changed to $S_{o4'}$ and $V_{n4'}$ respectively, the roll opening of stand 3 is changed to $S_{o3,B}$ and the roll speeds of stands 3, 2 and 1 are changed to the values determined by equation (5). As the size changing point reaches stand 5, the roll openings of the stands 4 and 5 are changed to $S_{o4,B}$ and $S_{o5,B}$ respectively. At the same time, the computer 26 supplies to the current regulator 20 a tension reel current reference of the B schedule for changing the front tension of stand 5 to that of the B schedule. Concurrently therewith, the roll speeds of stands 1 to 4 are changed to set roll speeds $V_{n1,B}$–$V_{n4,B}$ respectively of the B schedule.

By the steps described above, the operation of the mill has changed to the B schedule from the A schedule.

Even when there are more than 2 size changing points, the size can be readily changed by repeating similar steps.

As above described, the invention provides a novel method of controlling a tandem rolling mill according to which when the pass schedule is changed during the operation of the mill it is possible to minimize the variation in the strip tension and hence to decrease various difficulties and the amount of off gauge product produced.

I claim:

1. A method of controlling a tandem rolling mill including $n$ stands, where $n$ is an integer, and utilized to roll a metal strip, said method comprising the steps of, at the time of changing the pass schedule during the operation of the mill, and before the size changing point of the strip reaches the first stand; changing the roll speed of the last stand to that of after size changing; changing the roll speeds of the other mill stands while maintaining the speed ratio of before size changing; when the size changing point reaches any intermediate stand ($i$th stand) between the first and $(n-1)$th stands, changing the roll speed of the $i$th stand so as to maintain the exit strip speed thereof at the speed of before size changing; at the same time changing the roll opening of the $i$th stand so as to maintain the interstand strip tension between the $i$th and $(i+1)$th stands at the value of before size changing but to change the exiting strip gauge of the $i$th stand to a predetermined target value of after size changing; changing the roll opening of the $(i-1)$th stand to a predetermined set value of after size changing; changing the roll speeds of the roll stands on the upstream side of the $i$th stand while maintaining the volume speed of after size changing; and when the size changing point reaches the last stand; changing the roll openings of the last and the $(n-1)$th stands to predetermined set values of after size changing while at the same time changing the roll speeds of the first to the $(n-1)$th stands to predetermined preset values of after size changing.

* * * * *